US008941022B2

(12) United States Patent
Kim et al.

(10) Patent No.: US 8,941,022 B2
(45) Date of Patent: Jan. 27, 2015

(54) SWITCHING APPARATUS

(75) Inventors: Taehyun Kim, Chiyoda-ku (JP); Haruhiko Shimoji, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 169 days.

(21) Appl. No.: 13/821,616

(22) PCT Filed: Jan. 28, 2011

(86) PCT No.: PCT/JP2011/051703

§ 371 (c)(1),
(2), (4) Date: Mar. 8, 2013

(87) PCT Pub. No.: WO2012/086216

PCT Pub. Date: Jun. 28, 2012

(65) Prior Publication Data

US 2013/0161291 A1 Jun. 27, 2013

(30) Foreign Application Priority Data

Dec. 20, 2010 (JP) ..... 2010-282923

(51) Int. Cl.

| | |
|---|---|
| ***H01H 33/66*** | (2006.01) |
| ***H01H 33/666*** | (2006.01) |
| ***H01H 3/32*** | (2006.01) |
| *H01H 33/42* | (2006.01) |

(52) U.S. Cl.

CPC ..... *H01H 33/666* (2013.01); *H01H 3/32* (2013.01); *H01H 2033/426* (2013.01)

USPC ..... 218/140; 218/118; 218/154

(58) Field of Classification Search

USPC ..... 218/118, 140, 154

See application file for complete search history.

(56) References Cited

U.S. PATENT DOCUMENTS

| | | | | |
|---|---|---|---|---|
| 6,410,875 | B2 * | 6/2002 | Allard et al. | 218/118 |
| 8,445,805 | B2 * | 5/2013 | Glaser | 218/140 |
| 2006/0086694 | A1 * | 4/2006 | Benke et al. | 218/154 |
| 2012/0312667 | A1 * | 12/2012 | Hasegawa et al. | 200/288 |

FOREIGN PATENT DOCUMENTS

| | | | |
|---|---|---|---|
| EP | 0 704 872 | A1 | 4/1996 |
| JP | 44-16500 | Y1 | 7/1969 |
| JP | 46-15202 | Y1 | 5/1971 |
| JP | 54-54859 | U | 4/1979 |

(Continued)

OTHER PUBLICATIONS

International Search Report (PCT/ISA/210) issued on Apr. 26, 2011, by the Japanese Patent Office as the International Searching Authority for International Application No. PCT/JP2011/051703.

*Primary Examiner* — Truc Nguyen

(74) *Attorney, Agent, or Firm* — Buchanan Ingersoll & Rooney PC

(57) ABSTRACT

A switching apparatus includes: a vacuum valve which houses a fixed side electrode fixed to a fixed current-carrying shaft and a movable side electrode fixed to a movable current-carrying shaft coaxially arranged with the fixed current-carrying shaft in face-to-face relation to the fixed side electrode; and a buffering mechanism which is coaxially disposed with the fixed current-carrying shaft on the fixed side of the vacuum valve and reduces a collision load at the time when the movable side electrode is close contact with the fixed side electrode.

18 Claims, 4 Drawing Sheets

(56) References Cited

FOREIGN PATENT DOCUMENTS

| | | | |
|---|---|---|---|
| JP | 56-49030 | U | 5/1981 |
| JP | 56-148840 | U | 11/1981 |
| JP | 58-41952 | U | 3/1983 |
| JP | 58-039269 | B2 | 8/1983 |
| JP | 58-178246 | U | 11/1983 |
| JP | 62-120237 | U | 7/1987 |
| JP | 5-190063 | A | 7/1993 |
| JP | 9-147701 | A | 6/1997 |
| JP | 2004-355937 | A | 12/2004 |
| JP | 2006-164654 | A | 6/2006 |

* cited by examiner

SWITCHING APPARATUS

TECHNICAL FIELD

The present invention relates to switching apparatuses and, more particularly, relates to a switching apparatus such as a switchgear.

BACKGROUND ART

Generally, when a pair of contacts in an open contact state are closed (close contact) at a certain speed in a power switchgear and a switchgear, bounce (hereinafter, referred to as chattering) is generated between the contacts. A voltage is applied between the contacts; and therefore, arc is generated for each chattering and contact surfaces become coarse or waste away, so that there is a demerit that contact resistance unnecessarily increases.

Furthermore, a problem exists that when duration time of the chattering is long, the contacts fuse; and therefore, the duration time of the chattering needs to be shortened as much as possible.

In a switching apparatus of a known art shown in FIG. 8, a vacuum valve 1 houses a fixed contact 10 and a movable contact 11. The vacuum valve 1 is fixed to a fixed conductor 6 and the fixed conductor 6 is supported by a plurality of overlapped coned disc springs 63. The coned disc springs 63 are of an elastic body and the plurality of coned disc springs are overlapped and stacked.

Therefore, the coned disc springs 63 are minutely movably moved and a plurality of minute collisions are repeated to consume kinetic energy with respect to the bounce (chattering) generated at the time when the movable contact 11 in the vacuum valve 1 is operated to collide with the fixed contact 10. In doing so, the chattering is suppressed. Incidentally, the height of the coned disc springs 63 is set so as to obtain a predetermined buffering force by adjusting the clamping force of fixing bolts 62 according to the switching apparatus with respect to a load which makes the movable contact 11 operate so to be in a close contact state with the fixed contact 10.

[Patent Document 1] Japanese Unexamined Patent Publication No. 2006-164654

DISCLOSURE OF THE INVENTION

Problems to be Solved by the Invention

In the aforementioned known switching apparatus, support is made by a plurality of shaft lines parallel to a shaft center line of a movable shaft 2 of the vacuum valve 1 fixed to the fixed conductor 6. That is, support shaft lines parallel to the shaft center line of the movable shaft 2 are provided on the outer radial side than the vacuum valve 1 respectively; and the plurality of overlapped coned disc springs 63 are arranged on each of the respective support shaft lines between an insulation fixed base 61 and the fixed conductor 6 to fix and support by performing load adjustment so as to allow a minutely movable movement by the fixing bolt 62 respectively.

As described above, fixation and support are made by arranging the plurality of overlapped coned disc springs 63 on the support shaft lines parallel to the shaft center line of the movable shaft 2 on the outer radial side than the vacuum valve 1; and accordingly, the vacuum valve 1 is stably supported. However, the structure is provided by overlapping the coned disc springs 63 on the plurality of support shaft lines; and therefore, a work man-hour is required for the load adjustment of the coned disc springs 63.

That is, generally, mechanical height adjustment of the coned disc springs 63 needs to be adjusted by actual measurement, the adjustment work has difficulty, and the coned disc springs 63 are overlapped in two steps; and thus, the height adjustment further becomes difficult. However, a problem exists in that the coned disc springs 63 overlapped in two steps are arranged on the plurality of support shaft lines; and therefore, a work man-hour of the load adjustment of the coned disc springs 63 is required plural times and a large amount of effort is required. Furthermore, a problem exists in that the load adjustment work of the coned disc springs 63 needs to be performed in a state where the vacuum valve 1, which is a sensitive component, is fixed to the fixed conductor 6 and the load adjustment work needs to be carefully concentrated. Further, a problem exists in that, the coned disc springs 63 is supported on the plurality of support shaft lines to allow the minutely movable movement; and therefore, a prevention mechanism of operational failure (not shown in the drawing) due to shaft center deviation needs to be separately provided and a cost increases.

In addition, a problem exists in that, the influence of deformation of the fixed conductor 6 is prevented; and therefore, the structure is such that the fixed conductor 6 thickens, both sides of the fixed conductor 6 are significantly projected to the outer radial side than the vacuum valve 1, and a cost increases. Further, a problem exists in that, both sides of the fixed conductor 6 are significantly projected to the outer radial side than the vacuum valve 1; and therefore, the distance between the vacuum valve 1 and the ground becomes large for ensuring withstand voltage performance in a radial direction, the entire switching apparatus becomes large, and both size and cost increase.

The present invention has been made to solve the problem described above, and an object of the present invention is to provide a switching apparatus in which a reduction in size can be achieved and a reduction in cost can be achieved.

Means for Solving the Problems

According to the present invention, there is provided a switching apparatus including: a vacuum valve which houses a fixed side electrode fixed to a fixed current-carrying shaft and a movable side electrode fixed to a movable current-carrying shaft coaxially arranged with the fixed current-carrying shaft in face-to-face relation to the fixed side electrode; a basic shaft having a shaft section coaxially arranged with the fixed current-carrying shaft, a basic section attached to the fixed side of the vacuum valve on one side of the shaft section, and a thread section formed on the other side of the shaft section; a shaft support body attached by insertion to the basic shaft; a support member which supports the shaft support body and suppresses the basic shaft from moving in a radial direction; an elastic body concentrically attached by insertion to the shaft section between the shaft support body and the basic section of the basic shaft; and an adjustment member which is screwed to the thread section of the basic shaft and performs load adjustment of the elastic body.

Advantageous Effect of the Invention Brief

According to a switching apparatus of the present invention, there can be obtained a switching apparatus in which a reduction in size can be achieved and a reduction in cost can be achieved.

MODE FOR CARRYING OUT THE INVENTION

Embodiment 1

Figure 1:
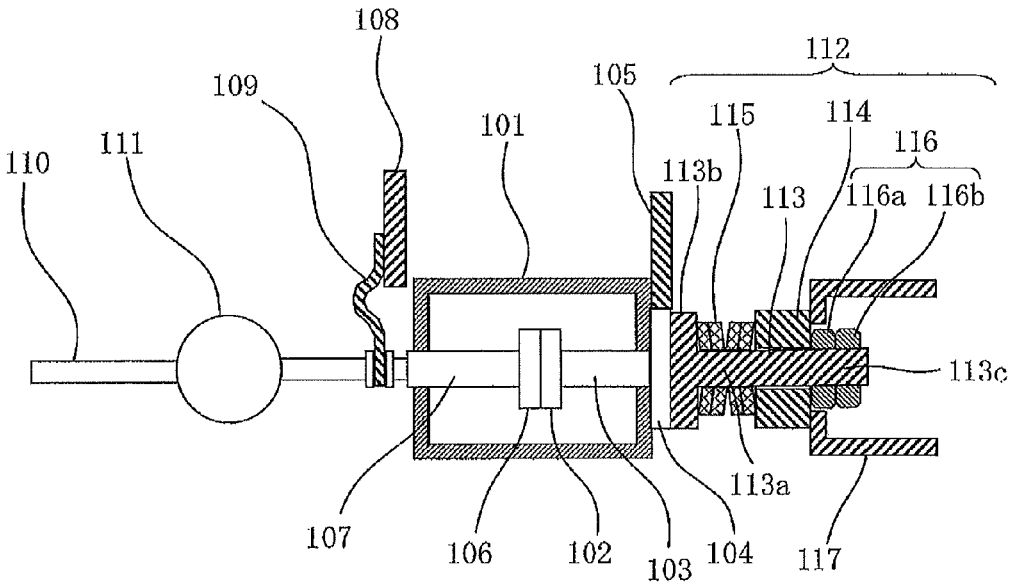
FIG. 1 is a sectional view showing a switching apparatus according to Embodiment 1 of the present invention.
Figure 2:
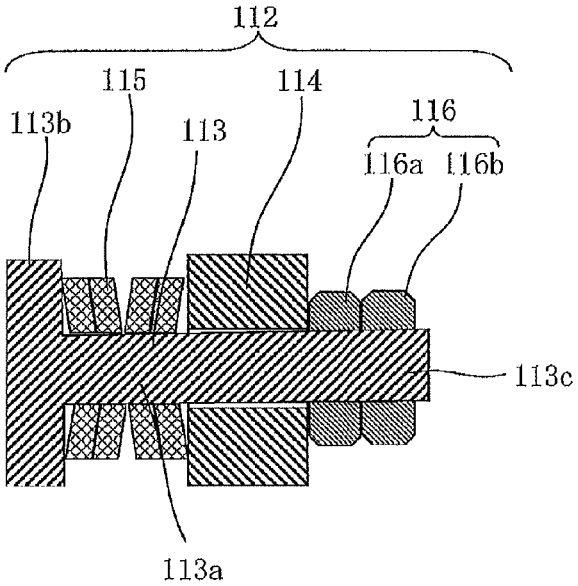
FIG. 2 is a sectional view showing a buffering mechanism in a switching apparatus according to Embodiment 1 of the present invention.

Hereinafter, Embodiment 1 of the present invention will be described with reference to FIG. 1 to FIG. 2. Then, in each of the drawings, identical or equivalent members and portions will be described with the same reference numerals assigned thereto. FIG. 1 is a sectional view showing a switching apparatus according to Embodiment 1 of the present invention. FIG. 2 is a sectional view showing a buffering mechanism in the switching apparatus according to Embodiment 1 of the present invention.

Reference numeral 101 denotes a vacuum valve; and 102 denotes a fixed side electrode which is arranged in the vacuum valve 101 and is fixed to a fixed current-carrying shaft 103. The fixed side electrode 102 is electrically connected to a fixed conductor 104 and a fixed side terminal conductor 105 via the fixed current-carrying shaft 103. 106 denotes a movable side electrode which is arranged in the vacuum valve 101 and is fixed to a movable current-carrying shaft 107 coaxially arranged with the fixed current-carrying shaft 103 in face-to-face relation to the fixed side electrode 102. 108 denotes a movable side terminal conductor; and 109 denotes a shunt conductor which electrically connects the movable side terminal conductor 108 to the movable current-carrying shaft 107 extending outside the vacuum valve 101 and has flexibility. Incidentally, the fixed conductor 104 and the fixed side terminal conductor 105 can be an integrated structure.

110 denotes an operating rod connected to an operating mechanism (not shown in the drawing). The operating rod 110 is connected to the movable current-carrying shaft 107 and drives the movable current-carrying shaft 107 in an axial direction to make the movable side electrode 106 bring into contact with the fixed side electrode 102 to be a close contact state and to make the movable side electrode 106 separate from the fixed side electrode 2 to be an open contact state. An insulating rod 111 is provided between the operating rod 110 and the movable current-carrying shaft 107; and the operating rod 110 and the movable current-carrying shaft 107 are insulated by the insulating rod 111 and are electrically interrupted.

112 denotes a buffering mechanism which is coaxially disposed with the fixed current-carrying shaft 103 on the fixed side of the vacuum valve 101 and reduces a collision load at the time when the movable side electrode 106 is brought into contact to be close contact with the fixed side electrode 102.

The buffering mechanism 112 is composed of: for example, a basic shaft 113 having a shaft section 113*a* coaxially arranged with the fixed current-carrying shaft 103, a basic section 113*b* to be attached on one side of the shaft section 113*a* to the fixed conductor 104 that is on the fixed side of the vacuum valve 101, and a thread section 113*c* formed on the other side of the shaft section 113*a*; a shaft support body 114 attached by insertion to the shaft section 113*a* of the basic shaft 113; an elastic body 115 concentrically attached by insertion to the shaft section 113*a* between the shaft support body 114 and the basic section 113*b* of the basic shaft 113; and an adjustment member 116 which is screwed to the thread section 113*c* of the basic shaft 113 and performs load adjustment of the elastic body 115. Incidentally, the shaft support body 114 is provided with a minute gap so as to be capable of minutely moving the shaft section 113*a* of the basic shaft 113 in an axial direction and the shaft support body 114 is supported by a support member 117; and accordingly, a radial movement is fixed.

Furthermore, there is shown a case where the elastic body 115 is formed by coned disc springs and the adjustment member 116 is formed by, for example, a first nut 116*a* and a second nut 116*b*. The load adjustment of the coned disc springs serving as the elastic body 115 is performed by clamping adjustment of the first nut 116*a*; and its adjusted load state is maintained by the second nut 116*b*.

A manufacturing process of such buffering mechanism 112 is manufactured separately from a manufacturing process of the vacuum valve 101; the load adjustment is performed independently by the buffering mechanism 112; and the buffering mechanism 112 in a state where the load adjustment has been completed is coaxially disposed with the fixed current-carrying shaft 103 on the fixed conductor 104 that is on the fixed side of the vacuum valve 101.

Next, operation will be described. In the case where the movable side electrode 106 and the fixed side electrode 102 of the vacuum valve 101 are from an open contact state to a close contact state, an operating mechanism (not shown in the drawing) is driven and the operating rod 110 connected to the operating mechanism (not shown in the drawing) is driven in the axial direction toward the fixed side electrode 102. The movable current-carrying shaft 107 connected to the operating rod 110 moves in the axial direction toward the fixed side electrode 102 by the driving in the axial direction of the operating rod 110; and accordingly, the movable side electrode 106 comes into contact with the fixed side electrode 102 at a predetermined load to be the close contact state and the movable side electrode 106 is electrically connected to the fixed side electrode 102 to be capable of being energized.

When the movable side electrode 106 comes into contact with, that is, collides with the fixed side electrode 102 at the predetermined load, chattering is generated between the movable side electrode 106 and the fixed side electrode 102; however, in Embodiment 1, the chattering can be suppressed in stable condition by the buffering mechanism 112 coaxially disposed with the movable current-carrying shaft 107 and the fixed current-carrying shaft 103.

That is, according to Embodiment 1, the chattering is suppressed on one support shaft line by the buffering mechanism 112 coaxially disposed with the movable current-carrying shaft 107 and the fixed current-carrying shaft 103; and a load at the time when the movable side electrode 106 collides with the fixed side electrode 102 is transmitted to the fixed current-carrying shaft 103 and the fixed conductor 104. The load transmitted to the fixed conductor 104 is transmitted to the basic section 113*b* of the basic shaft 113 serving as the buffering mechanism 112 to compress the coned disc springs serving as the elastic body 115 by the basic section 113*b* of the basic shaft 113, and the load at the time when the movable side electrode 106 collides with the fixed side electrode 102 is absorbed and reduced; and accordingly, the chattering is suppressed in stable condition.

As described above, Embodiment 1 is not the structure which is provided by overlapping the coned disc springs 63 on the plurality of support shaft lines on the outer radial side than the vacuum valve 1 as described in the aforementioned known switching apparatus; but, in Embodiment 1, the buffering mechanism 112 is coaxially disposed with the movable current-carrying shaft 107 and the fixed current-carrying shaft 103. Accordingly, the radial dimension of the vacuum valve 101 can be considerably shortened than the aforementioned known switching apparatus. Therefore, withstand voltage performance in the radial direction can be improved and the entire switching apparatus becomes small; and thus, a reduction in size can be achieved and a reduction in cost can be achieved.

Furthermore, the aforementioned known switching apparatus has the structure in which both sides of the fixed conductor 6 are significantly projected to the outer radial side than the vacuum valve 1; and therefore, the thickness needs to be thickened. Whereas, in Embodiment 1, the buffering mechanism 112 is coaxially disposed with the movable current-carrying shaft 107 and the fixed current-carrying shaft 103; and therefore, the influence of deformation of the fixed conductor 104 becomes extremely small and a reduction in size of the fixed conductor 104 can be achieved.

In addition, the load adjustment of the buffering mechanism 112 is performed by the coned disc springs serving as the elastic body 115 coaxially disposed with the movable current-carrying shaft 107 and the fixed current-carrying shaft 103 on one support shaft line; and the load adjustment may be performed only one time; and therefore, a work man-hour can be more reduced than that of the load adjustment of the coned disc springs 63 on the plurality of support shaft lines as described in the aforementioned known switching apparatus, and the reduction in cost can be further made.

Further, the buffering mechanism 112 is coaxially disposed with the movable current-carrying shaft 107 and the fixed current-carrying shaft 103 on one support shaft line; and therefore, operational failure associated with interference due to on the plurality of support shaft lines as described in the aforementioned known switching apparatus does not exist and a suppression effect of stable chattering can be obtained.

By the way, the buffering mechanism 112 in Embodiment 1 is manufactured separately from a manufacturing process of the vacuum valve 101; the load adjustment is performed independently by the buffering mechanism 112; and the buffering mechanism 112 that is a finished product in a state where the load adjustment has been completed can be coaxially disposed with the fixed current-carrying shaft 103 on the fixed conductor 104 that is on the fixed side of the vacuum valve 101. Therefore, it is not necessary that the load adjustment work of the coned disc springs 63 is carefully concentrated in a state where the vacuum valve 1 of a sensitive component is fixed to the fixed conductor 6 as described in the aforementioned known switching apparatus; and therefore, a work man-hour of protection or the like of the vacuum valve 101 can also be reduced, assembling workability of the switching apparatus can be remarkably improved, and the reduction in cost can be further achieved.

Furthermore, the buffering mechanism 112 can individually perform the load adjustment of the coned disc springs serving as the elastic body 115; and therefore, the reduction in cost can be further achieved during mass production of the switching apparatus.

Embodiment 2

Figure 3:
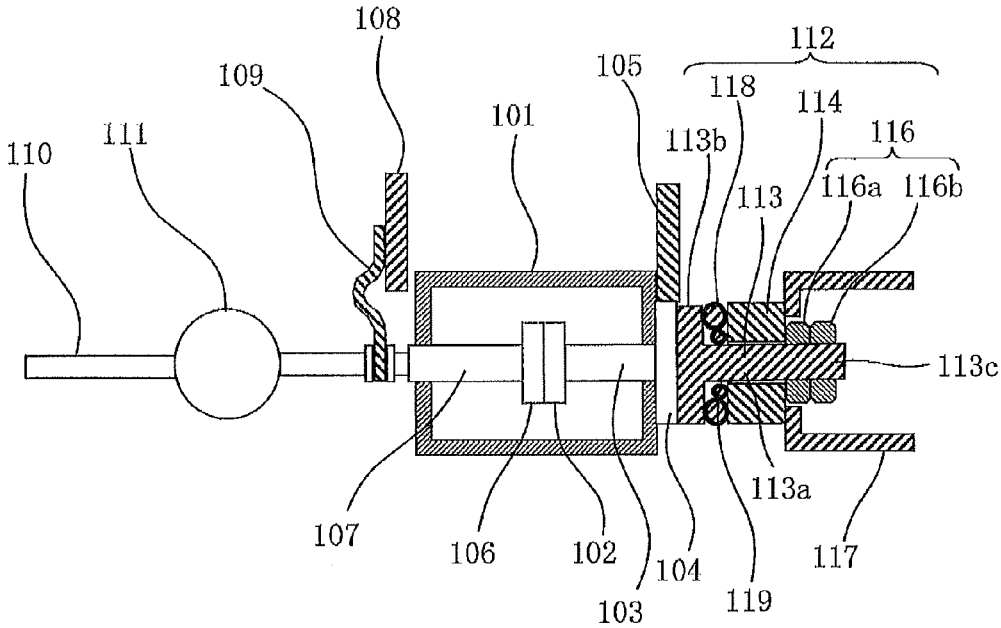
FIG. 3 is a sectional view showing a switching apparatus according to Embodiment 2 of the present invention.

Embodiment 2 of the present invention will be described with reference to FIG. 3. Then, in the drawing, identical or equivalent members and portions will be described with the same reference numerals assigned thereto. FIG. 3 is a sectional view showing a switching apparatus according to Embodiment 2 of the present invention.

The description has been made on the case where the elastic body 115 is formed by the coned disc springs in the aforementioned Embodiment 1; however, in Embodiment 2, an elastic body 118 is formed of a rubber material. The drawing shows the elastic body 118 formed by an O-ring as an example.

According to Embodiment 2, load adjustment is performed in a compressed state of the O-ring serving as the elastic body 118; and similar effects to the aforementioned Embodiment 1 can be exhibited.

Furthermore, a compressed state maintaining member 119, which maintains a compressed state of the O-ring at a predetermined state, is disposed on the inner circumferential side of the O-ring serving as the elastic body 118. The compressed state maintaining member 119 is formed by, for example, a harder circular member than a material of the O-ring serving as the elastic body 118 so that the O-ring serving as the elastic body 118 is not compressed beyond the position of the compressed state maintaining member 119.

Embodiment 3

Figure 4:
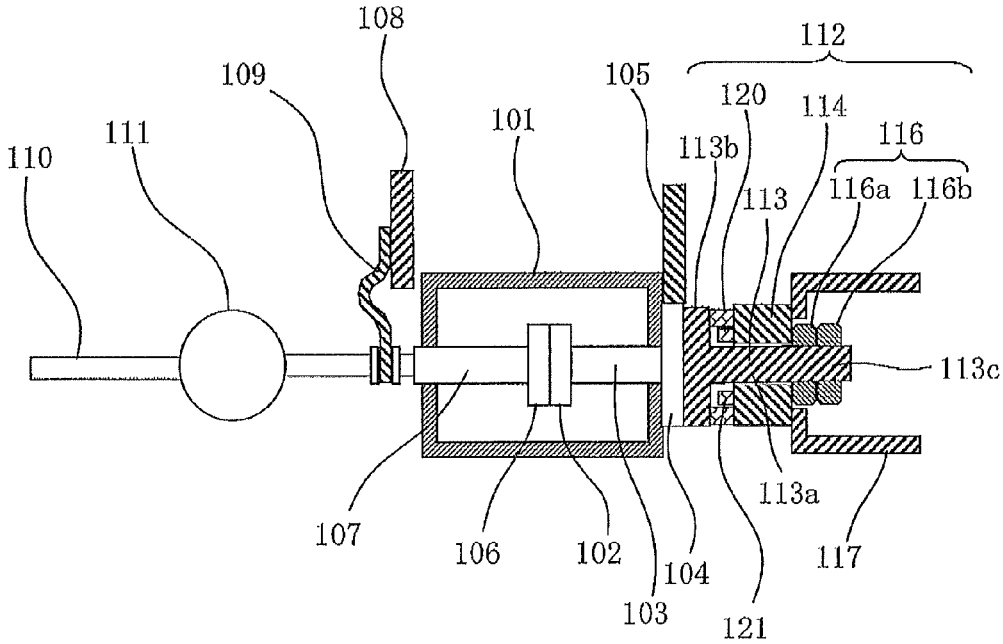
FIG. 4 is a sectional view showing a switching apparatus according to Embodiment 3 of the present invention.
Figure 5:
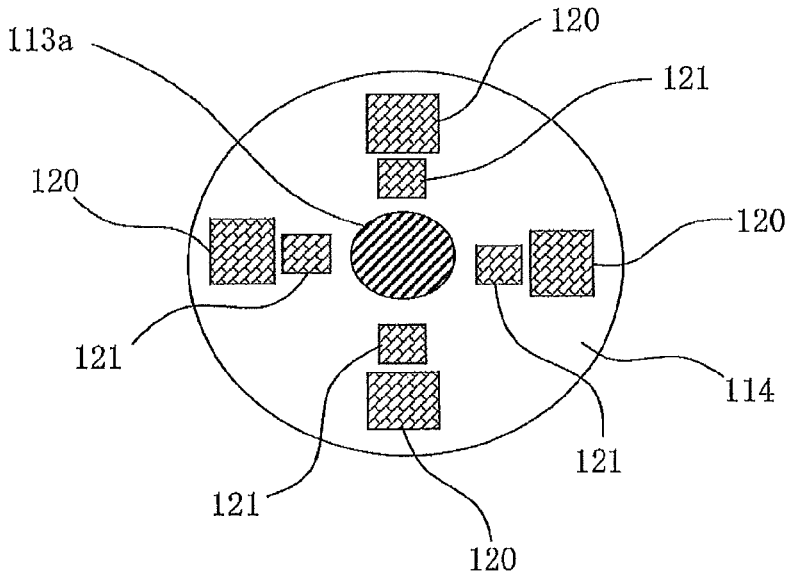
FIG. 5 is a relevant part sectional side view of FIG. 4 showing the switching apparatus according to Embodiment 3 of the present invention.

Embodiment 3 of the present invention will be described with reference to FIG. 4 to FIG. 5. Then, in each of the drawings, identical or equivalent members and portions will be described with the same reference numerals assigned thereto. FIG. 4 is a sectional view showing a switching apparatus according to Embodiment 3 of the present invention. FIG. 5 is a relevant part sectional side view of FIG. 4 showing the switching apparatus according to Embodiment 3 of the present invention.

The description has been made on the case where the elastic body 118 is formed by the O-ring made of the rubber material in the aforementioned Embodiment 2; and in the case where the load adjustment of the elastic body 118 cannot be performed within a compression range of the O-ring, the elastic body 118 formed by the O-ring needs to be replaced after removing the shaft section 113*a* of the basic shaft 113 of the buffering mechanism 112 from the shaft support body 114. However, in Embodiment 3, as shown in FIG. 5, a case where an elastic body 120 formed of a rubber material is divided and arranged in axial symmetry is shown.

According to Embodiment 3, when there is a state where load adjustment of the elastic body 120 cannot be performed within a compression range of the elastic body 120 formed of the rubber material, the elastic body 120 being divided and arranged in axial symmetry, the elastic body 120 which is divided and formed of the rubber material is attached or detached without removing a shaft section 113*a* of a basic shaft 113 of a buffering mechanism 112 from a shaft support body 114; and accordingly, the elastic body 120 formed of the rubber material may only be replaced and workability is more improved than that of the aforementioned Embodiment 2.

Furthermore, a compressed state maintaining member 121, which maintains a compressed state of the rubber material serving as the elastic body 120 in a predetermined state, is divided and arranged in axial symmetry on the inner circumferential side of the elastic body 120 formed of the rubber material, the elastic body being divided and arranged in axial symmetry. The compressed state maintaining member 121 is formed by, for example, a harder member than the rubber material serving as the elastic body 120 so that the rubber material serving as the elastic body 120 is not compressed beyond the position of the compressed state maintaining member 121.

Incidentally, there is shown a case where the elastic body 120 and the compressed state maintaining member 121 are formed in a quadrangular column shape; however, the elastic body 120 and the compressed state maintaining member 121 are not limited to this shape, for example, a polygonal column shape and a cylinder shape may be permissible and similar effects can be exhibited.

Embodiment 4

Figure 6:
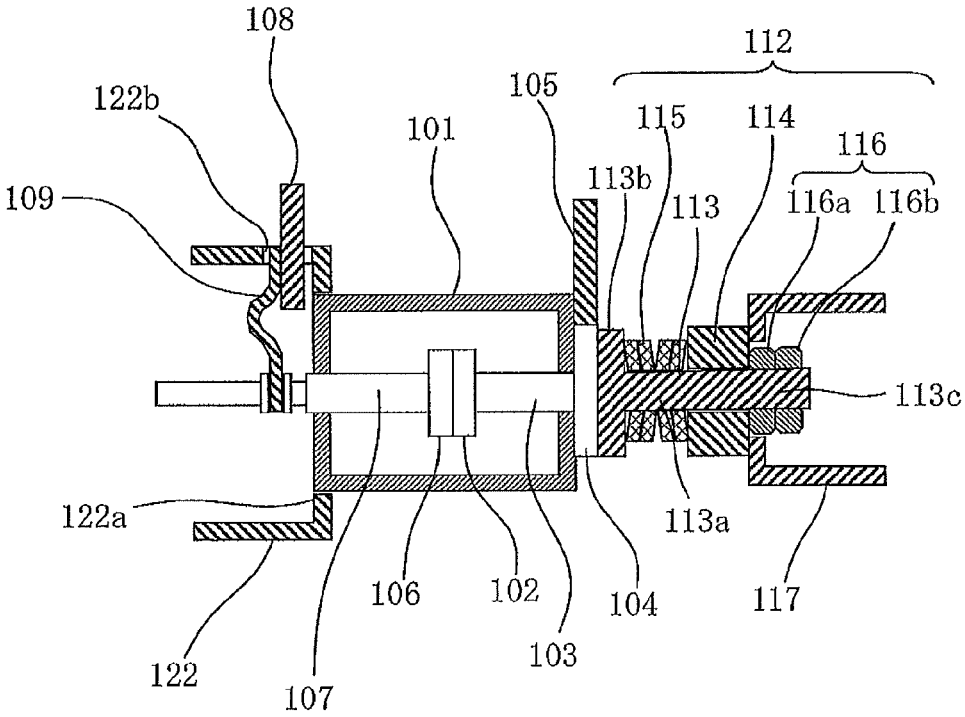
FIG. 6 is a sectional view showing a switching apparatus according to Embodiment 4 of the present invention.

Embodiment 4 of the present invention will be described with reference to FIG. 6. Then, in the drawing, identical or equivalent members and portions will be described with the same reference numerals assigned thereto. FIG. 6 is a sectional view showing a switching apparatus according to Embodiment 4 of the present invention.

In Embodiment 4, there is shown a case where a suppression member 122 is arranged on the movable side of a vacuum valve 101 so that the vacuum valve 101 is movable in an axial direction and is arranged so that the vacuum valve 101 is suppressed from moving in a radial direction. Incidentally, the suppression member 122 is formed with a pass through hole 122*b* through which a shunt conductor 109 and a movable side terminal conductor 108 pass through.

According to Embodiment 4, a suppression section 122*a* of the suppression member 122 and an outer circumferential portion on the movable side of the vacuum valve 101 are in face-to-face relation to each other via a slight gap so that the vacuum valve 101 is minutely movable in the axial direction, and the vacuum valve 101 is suppressed from moving to the outer radial side by the suppression section 122*a* of the suppression member 122.

As described above, the configuration is made such that the vacuum valve 101 is suppressed from moving to the outer radial side and is capable of minutely moving in the axial direction by the suppression section 122*a* of the suppression member 122; and therefore, a suppression effect of chattering can be improved.

Embodiment 5

Figure 7:
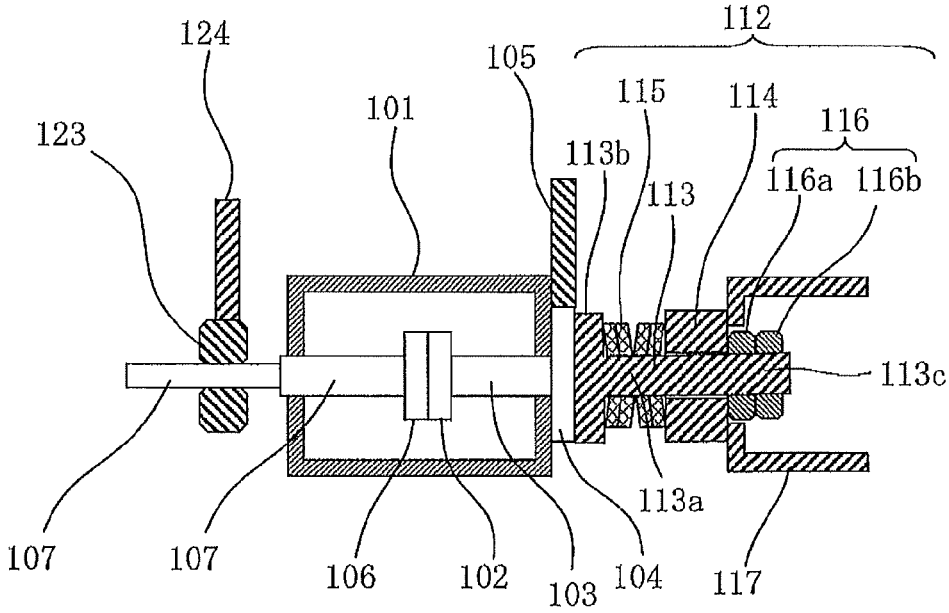
FIG. 7 is a sectional view showing a switching apparatus according to Embodiment 5 of the present invention.
Figure 8:
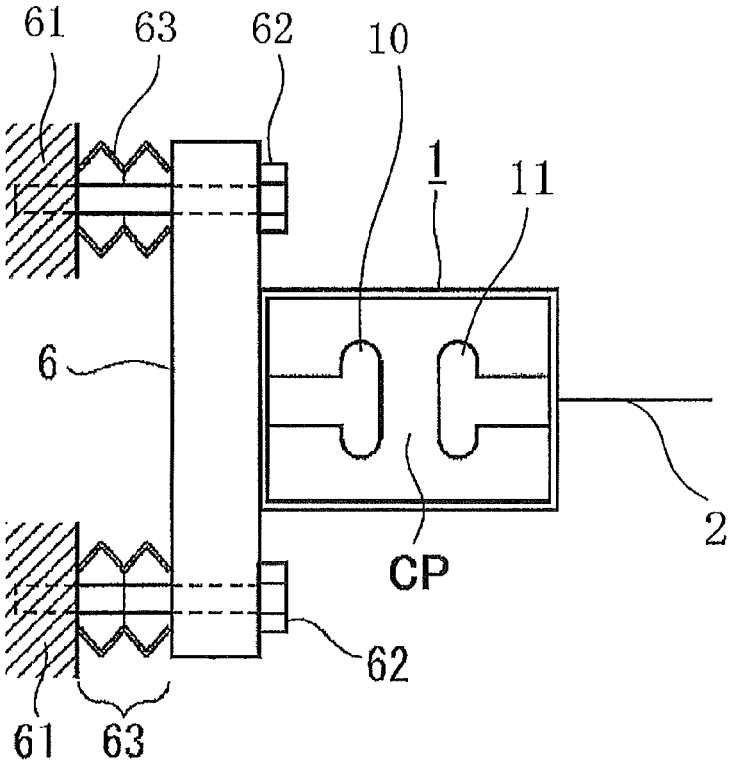
FIG. 8 is a sectional view showing a known switching apparatus.

Embodiment 5 of the present invention will be described with reference to FIG. 7. Then, in the drawing, identical or equivalent members and portions will be described with the same reference numerals assigned thereto. FIG. 7 is a sectional view showing a switching apparatus according to Embodiment 5 of the present invention.

In Embodiment 5, there is shown a case where a conductive bearing 123 made of a good conductor, by which a movable current-carrying shaft 107 is movably supported in an axial direction and is fixed against a movement in a radial direction, and a slide contact 124 that supports the conductive bearing 123 are provided. That is, this case is a state where the shunt conductor 109 and the movable side terminal conductor 108 are replaced with the conductive bearing 123 and the slide contact 124 respectively, and similar functions are provided.

According to Embodiment 5, the movable current-carrying shaft 107 is movably supported in the axial direction by the conductive bearing 123; and therefore, the movable current-carrying shaft 107 performs a similar operation to the aforementioned respective embodiments. Then, even when the configuration is made such that the movable current-carrying shaft 107 of the vacuum valve 101 is suppressed from moving to the outer radial side and is capable of moving in the axial direction by the conductive bearing 123 and the slide contact 124, a suppression effect of chattering can be improved.

INDUSTRIAL APPLICABILITY

The present invention is suitable for achieving a switching apparatus in which a reduction in size can be achieved and a reduction in cost can be achieved.

The invention claimed is:

1. A switching apparatus comprising:

a vacuum valve which houses a fixed side electrode fixed to a fixed current-carrying shaft and a movable side electrode fixed to a movable current-carrying shaft coaxially arranged with said fixed current-carrying shaft in face-to-face relation to said fixed side electrode;

a basic shaft having a shaft section coaxially arranged with said fixed current-carrying shaft, a basic section attached to the fixed side of said vacuum valve on one side of the shaft section, and a thread section formed on the other side of the shaft section;

a shaft support body attached by insertion to said basic shaft;

a support member which supports said shaft support body and suppresses said basic shaft from moving in a radial direction;

an elastic body concentrically attached by insertion to the shaft section between said shaft support body and the basic section of said basic shaft; and an adjustment member which is screwed to the thread section of said basic shaft and performs load adjustment of said elastic body.

2. The switching apparatus according to claim 1, wherein said elastic body is formed by a coned disc spring.

3. The switching apparatus according to claim 1, wherein said elastic body is formed of a rubber material.

4. The switching apparatus according to claim 3, wherein the rubber material of said elastic body is formed by an O-ring.

5. The switching apparatus according to claim 3, wherein the rubber material of said elastic body is divided in axial symmetry and arranged concentrically.

6. The switching apparatus according to claim 1, wherein said elastic body is formed of a rubber material, and further comprising a compressed state maintaining member which maintains a compressed state of the rubber material.

7. The switching apparatus according to claim 1, further comprising a suppression member which is arranged on the movable side of said vacuum valve so that said vacuum valve is movable in an axial direction and is arranged so that said vacuum valve is suppressed from moving in a radial direction.

8. The switching apparatus according to claim 2, further comprising a suppression member which is arranged on the movable side of said vacuum valve so that said vacuum valve is movable in an axial direction and is arranged so that said vacuum valve is suppressed from moving in a radial direction.

9. The switching apparatus according to claim 3, further comprising a suppression member which is arranged on the movable side of said vacuum valve so that said vacuum valve is movable in an axial direction and is arranged so that said vacuum valve is suppressed from moving in a radial direction.

10. The switching apparatus according to claim 4, further comprising a suppression member which is arranged on the movable side of said vacuum valve so that said vacuum valve is movable in an axial direction and is arranged so that said vacuum valve is suppressed from moving in a radial direction.

11. The switching apparatus according to claim 5, further comprising a suppression member which is arranged on the movable side of said vacuum valve so that said vacuum valve is movable in an axial direction and is arranged so that said vacuum valve is suppressed from moving in a radial direction.

12. The switching apparatus according to claim 6, further comprising a suppression member which is arranged on the movable side of said vacuum valve so that said vacuum valve is movable in an axial direction and is arranged so that said vacuum valve is suppressed from moving in a radial direction.

13. The switching apparatus according to 1, further comprising:

a conductive bearing made of a good conductor, which movably supports said movable current-carrying shaft in an axial direction and is fixed against a movement in a radial direction; and a slide contact which supports said conductive bearing.

14. The switching apparatus according to claim 2, further comprising:

a conductive bearing made of a good conductor, which movably supports said movable current-carrying shaft in an axial direction and is fixed against a movement in a radial direction; and a slide contact which supports said conductive bearing.

15. The switching apparatus according to claim 3, further comprising:

a conductive bearing made of a good conductor, which movably supports said movable current-carrying shaft in an axial direction and is fixed against a movement in a radial direction; and a slide contact which supports said conductive bearing.

16. The switching apparatus according to claim 4, further comprising:

a conductive bearing made of a good conductor, which movably supports said movable current-carrying shaft in an axial direction and is fixed against a movement in a radial direction; and a slide contact which supports said conductive bearing.

17. The switching apparatus according to claim 5, further comprising:

a conductive bearing made of a good conductor, which movably supports said movable current-carrying shaft in an axial direction and is fixed against a movement in a radial direction; and a slide contact which supports said conductive bearing.

18. The switching apparatus according to claim 6, further comprising:

a conductive bearing made of a good conductor, which movably supports said movable current-carrying shaft in an axial direction and is fixed against a movement in a radial direction; and a slide contact which supports said conductive bearing.

* * * * *